United States Patent [19]

Kramer

[11] 4,394,950

[45] Jul. 26, 1983

[54] APPARATUS FOR FLOATINGLY MOVING A LENGTH OF MATERIAL

[76] Inventor: Carl Kramer, Am Chorusberg 8, 5100 Aachen, Fed. Rep. of Germany

[21] Appl. No.: 279,219

[22] Filed: Jun. 30, 1981

[30] Foreign Application Priority Data

Jul. 10, 1980 [DE] Fed. Rep. of Germany ..... 3026132

[51] Int. Cl.[3] ..... B65H 17/32; F26B 13/00

[52] U.S. Cl. ..... 226/97; 34/156

[58] Field of Search ..... 226/7, 95, 97, 196; 34/23, 57 R, 57 A, 57 C, 155, 156, DIG. 13

[56] References Cited

U.S. PATENT DOCUMENTS 4,074,841 2/1978 Kramer et al. ..... 226/97
4,137,644 2/1979 Karlsson ..... 34/23
4,142,661 3/1979 Nettles et al. ..... 226/97
4,197,971 4/1980 Stibbe ..... 226/97
4,218,001 8/1980 Vits ..... 226/97

*Primary Examiner*—Leonard D. Christian
*Attorney, Agent, or Firm*—Armstrong, Nikaido, Marmelstein & Kubovcik

[57] ABSTRACT

An apparatus for guiding a length of web material in a floating manner which comprises a nozzle frame means with slit nozzles extending laterally transversely to the direction of motion of the length of material and having annular nozzles disposed between the slit nozzles for directing a blown medium against the web material. A guide vane grille is arranged along the axis of the nozzle frame means for the supplied blowing medium and a diffuser joins the guide-vane grill to create an exhaust impedence to delay the blowing medium.

12 Claims, 8 Drawing Figures

APPARATUS FOR FLOATINGLY MOVING A LENGTH OF MATERIAL

The invention relates to a system of nozzles to guide in a floating manner lengths of materials by means of a blowing medium. More specifically, the invention comprises nozzle frame means with slit nozzles extending transversely to the direction of motion of the length of material having hole nozzles between the slit nozzles.

Various designs of systems of nozzles to floatingly guide lengths of materials are already known. Illustratively, German Offenlegungsschrift No. 1,629,041, German Offenlegungsschrift No. 1,629,029, German Auslegeschrift No. 2,524,168, German Auslegeschrift No. 2,613,135, German Offenlegungsschrift No. 2,615,258, German patent No. 2,120,805 and German Offenlegungsschrift No. 2,450,000 are cited. These systems generally comprise a header pipe with individual nozzle frames extending perpendicularly thereto as ribs.

However, there are difficulties with these known systems of nozzles in that the blowing medium is introduced sideways into the individual ribs or nozzle frame means and thus flows strongly along the axis of the nozzle frame means. As a result, the flow issuing from the slit nozzles or hole nozzles comprises a relatively high component in that direction, e.g., the longitudinal axis of the frame means and, therefore, will not leave the nozzle frame means perpendicularly and hence also will not be normally incident on the length of material. The angle so generated and deviating from the normal between the slit and hole jets on one hand, and the material length on the other, causes a reduction in the generated support force which can be compensated, in turn, only by raising the flow rate in a costly manner. Moreover, instabilities are generated thereby at the sideways edges of the length of material which are especially noticeable with long equipment. The length of material receives a sideways component of force, together with the force levitating it.

It is, therefore, the object of the invention to create a system of nozzles of the species above which shall be free of the above drawbacks. In particular, a system of nozzles is proposed in which the flow is so controlled by a simple construction that it will issue practically perpendicularly from the nozzle frame means.

This is achieved by the invention by arranging a grille of guide vanes for the supplied blowing medium parallel to the axis of the nozzle frame means and by providing a diffuser to the grille of guide vanes with an exhaust impedance for the purpose of delaying the blowing medium without flow separation.

The advantages provided by the invention are especially based on the fact that the flow of the blowing medium entering sideways into the nozzle frame means from the header is deflected to such an extent by the grille of guide vanes that there practically is no flow component left along the axis of the nozzle frame means. This deflected flow component is delayed relatively substantially in the diffuser, whereby any slight impulsive flow component transverse to the direction of motion of the length of material still contained in the incoming flow the nozzle frame means will be reduced so that the material length is loaded by a flow issuing practically normally. Thus, the total flow incident on the length of material is converted into a support force and a good utilization of the flow rate present is achieved. Moreover, the sideways edges of the length of material are also stabilized.

The exhaust impedance of the diffuser is formed in a preferred embodiment by a perforated rectangular strip of sheetmetal, the perforations acting as the hole nozzles with the gap between the longitudinal edges of the rectangular strip of sheetmetal and the sidewalls of the nozzle frame means forming the slit nozzles. Keeping the width of the nozzle frame means constant while changing the width of the rectangular strip of sheetmetal and also by changing the size and number of the hole nozzles, it is possible to adapt this rectangular strip of sheetmetal, and hence the system of nozzles, to various requirements. The previously conventional systems of nozzles on the other hand, for instance, those described in the above patents or patent applications, are each designed to solve a specific problem. If such a piece of single-design equipment provided with such a system of nozzles should be used for a different purpose or if the operation of the equipment must be modified due to a change in the product to be guided therein (i.e., to be treated), then this can be done only, in general, by costly alterations such as, for example, by exchanging the entire system of nozzles.

Furthermore, there is a substantial change in the requirements, for instance as regards floating driers, for continuously drying tapes or ribbons that are coated on both sides, placed on the system of nozzles as a function of the deposited coating means and the length of the floating drier whereby, in many cases, the optimal nozzle loading method cannot be determined beforehand. One reason, for instance, for which a change in loading would be required is the varying change in viscosity of the coating means as the temperature rises at the tape or ribbon surface while passing through the floating drier.

Another substantial reason for changing the kind of loading by the flow incident on the length of material to be guided is, in particular, in equipment for wide lengths of materials of high thermal coefficient expansions, the transition from the heating to the cooling zones. If such a transition from a heating to a cooling zone takes place too abruptly, longitudinal folds may form in the length of material because of the thermal transverse contraction, resulting in an unstable state of the tape or ribbon or strip and in appreciable operational difficulties.

Lastly, it is an object of the invention to create similar equipment types for different thickness of materials, material stresses and different materials, without requiring the use of nozzle systems which would substantially differ from each other in design and manufacture.

This flexibility, which is absent in the known systems of nozzles, is achieved in the system of nozzles of the present invention in that the perforated rectangular strip of sheetmetal acting as the exhaust impedance is mounted in a detachable, and hence exchangeable, manner to the nozzle frame means. By merely exchanging such a rectangular strip of sheetmetal with another, the width of the slit nozzles, and hence that of the slit jets on one hand and the size and number of the hole nozzles and hence the hole jets on the other hand, can be varied over a wide range in order to vary the support force and the desired heat transfer accordingly, as will be discussed more comprehensively below.

Thus, the expensive exchange of the entire system of nozzles is no longer required. Rather, merely a single, relatively simple and hence easily manufactured component, namely the rectangular sheetmetal strip, can be exchanged even when highly different requirements are placed on the system of nozzles.

The invention is discussed in further detail below in relation to an illustrative embodiment and referring to the attached schematic drawings:

DETAILED DESCRIPTION OF THE INVENTION

Figure 1:
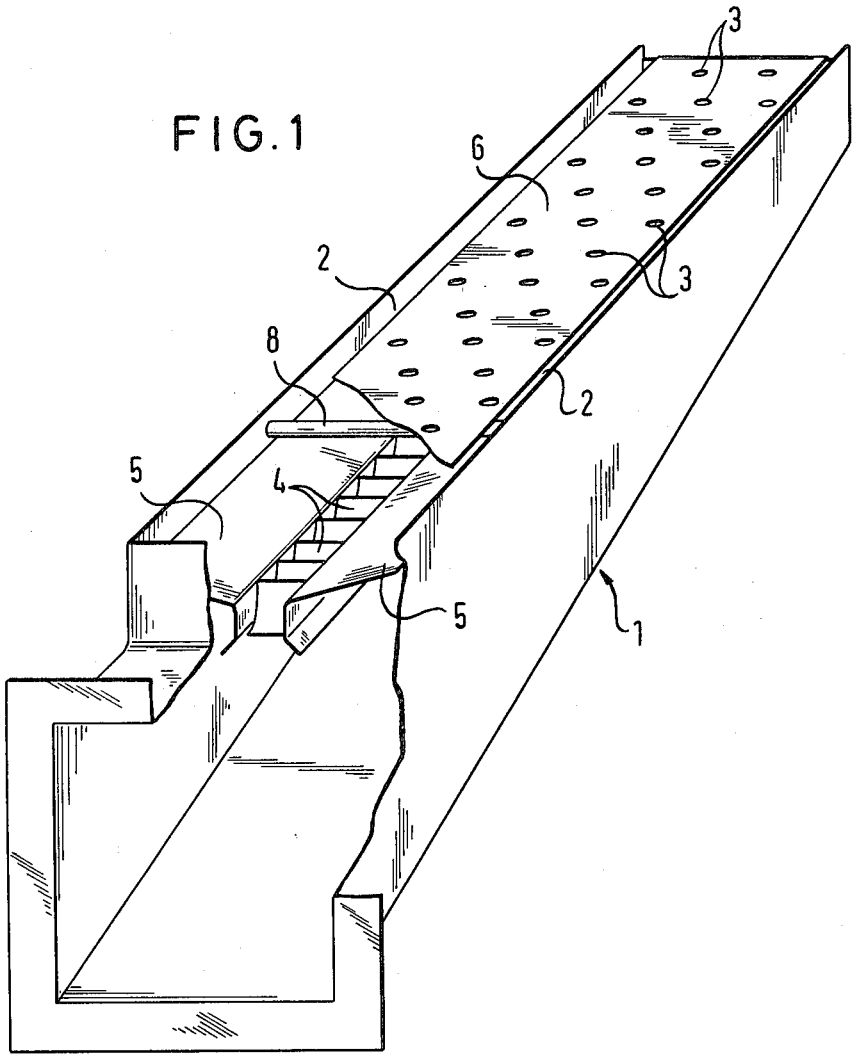
FIG. 1 is a perspective view of a nozzle frame means in accordance with the present invention.
Figure 2:
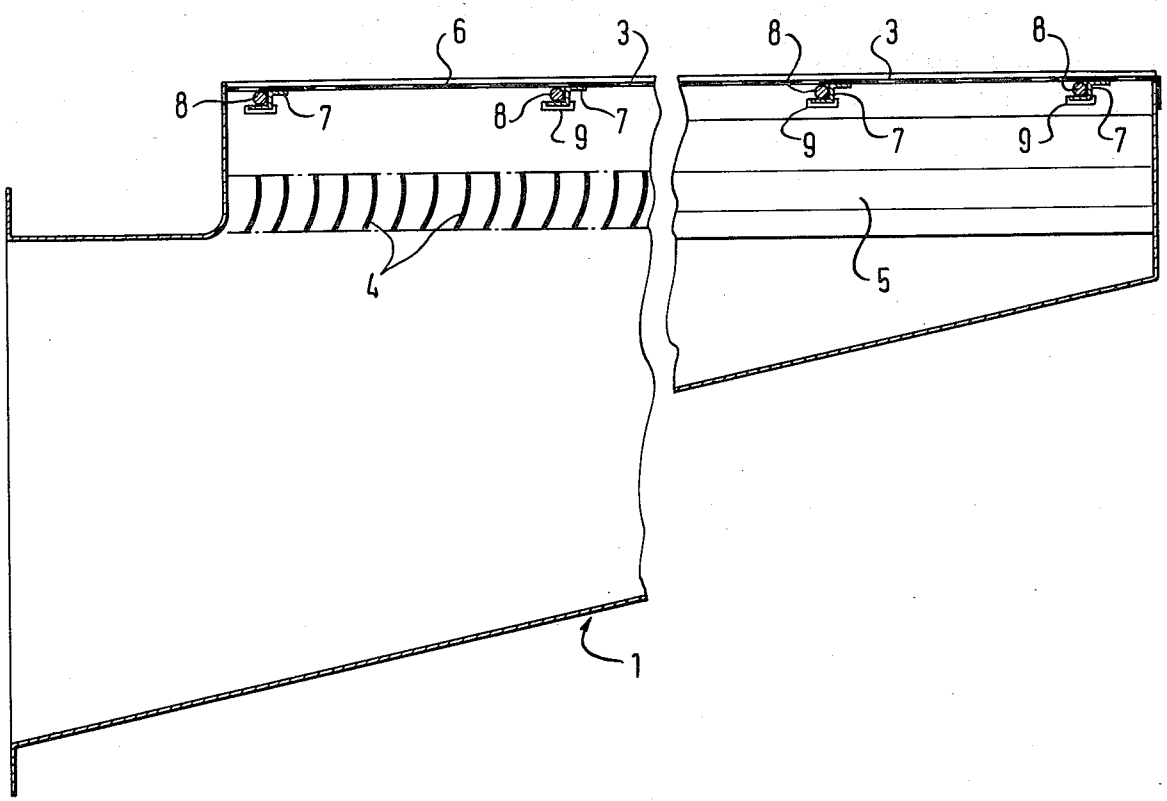
FIG. 2 is a longitudinal section of a nozzle frame means.

As shown particularly clearly in FIG. 1, the nozzle frame means is in the shape of a box of rectangular cross-section. This nozzle frame means 1 is connected to a source (omitted) of the gaseous blowing medium which flows in at the side, that is, in FIG. 1, through the open end into the box-shaped nozzle frame means 1.

From the clear, lower inside space of the box-shaped nozzle frame means 1, the blowing medium flows through a grille 4 of curved guide vanes, being so deflected in the process that above the guide vane grill 4, there practically is no longer a flow component along the axis of the nozzle frame means. Therefore, the initial sideways flow of the blowing medium from a header into the frame means is no longer noticeable.

The guide vane grille 4 is joined by a diffuser 5 which delays the flow that was deflected in the guide vane grille 4. This diffuser 5 is formed by two pieces of sheetmetal beginning at the sides of the guide vane grille 4 and extending at a slight upward slope as far as the inside wall of the box-shaped nozzle frame means 1, as shown especially in FIG. 3.

As the ratio of the width of the nozzle frame means 1 to the width of the guide vane grill 4, i.e., the width of the channel crossed by the blowing medium in the guide vane grill 4, is relatively large, there results a correspondingly large delay which decreases any slight impulsive flow components that might still be present transversely to the direction of motion of the length of material, namely in the longitudinal direction of the nozzle frame means 1, in such a manner that the material to be guided over the nozzle frame means 1 is loaded by a flow which issues practically vertically therefrom.

This vertical outflow is essential on account of lateral bleeding, especially as it takes place in long equipment but which is prevented by the steps discussed herein.

Figure 3:
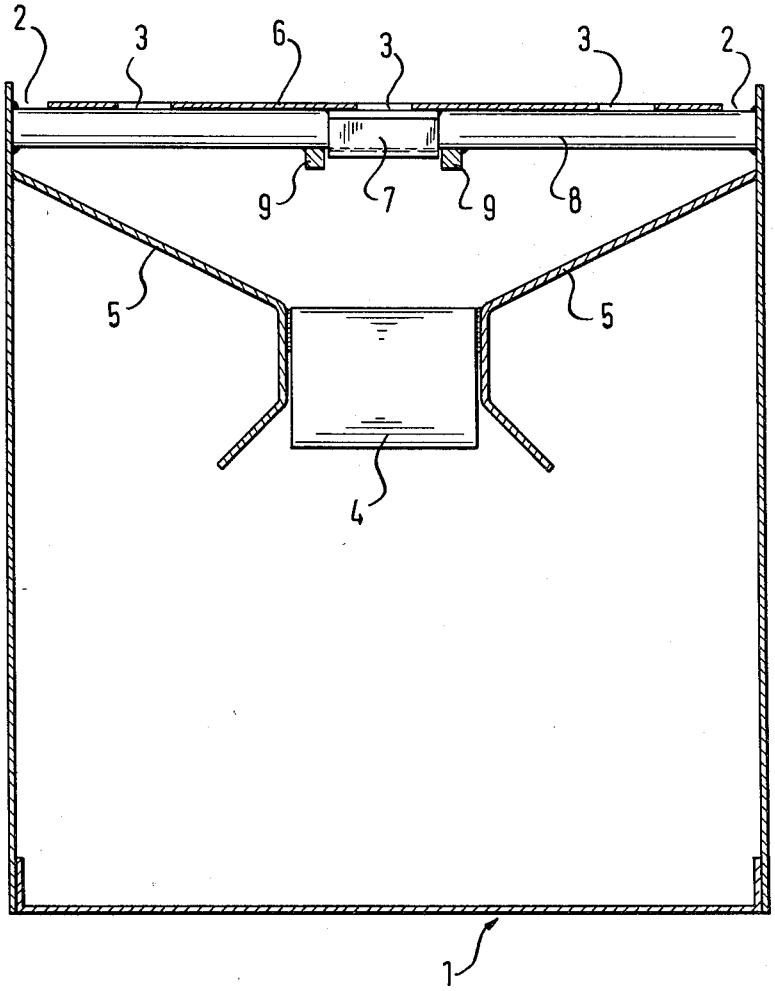
FIG. 3 is a cross-section of a nozzle frame means with the diffuser, the guide vane grille and the nozzle body formed by an exchangeable rectangular strip of sheetmetal.

The diffuser 5 is covered above by a rectangular sheetmetal strip 6 of a width somewhat less than that of the nozzle frame means 1 so that slit nozzles 2 are created between the longitudinal edges of the rectangular sheetmetal strip 6 and the inside edges of the upper rims of the nozzle frame means 1 as indicated especially in FIGS. 1 and 3. Moreover, the rectangular sheetmetal strip 6, which fills the role of nozzle body, is provided with circular nozzle holes 3 as shown especially clearly in FIGS. 1 and 4.

This rectangular sheetmetal strip 6 therefore acts as the exhaust impedance for the blowing medium delayed in the diffuser 5, whereby the flow issuing perpendicularly to the axis of the nozzle frame means will impact the length of material at a relatively high speed.

Figure 4:
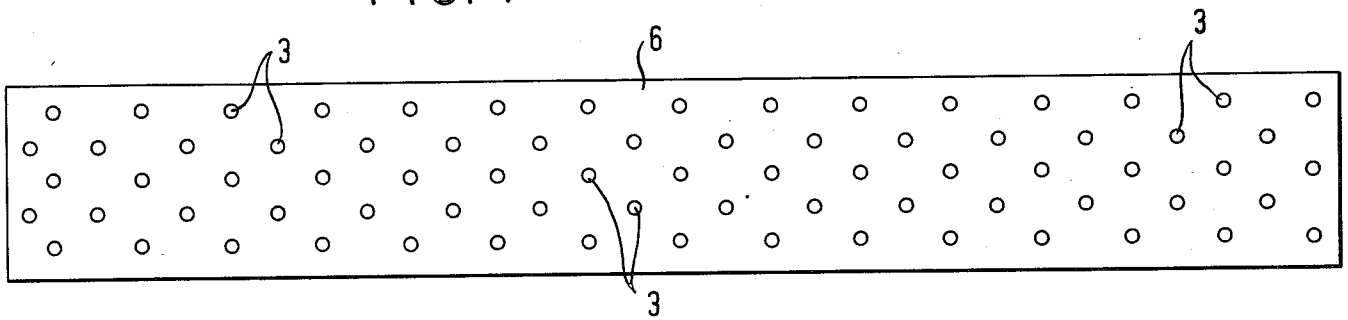
FIG. 4 is a top view of the rectangular sheetmetal strip.

As shown in FIG. 4, the center points of the hole nozzles in the rectangular sheetmetal strip 6 are located at the tips of equilateral triangles, thereby providing a very uniform distribution of the flow issuing from the hole nozzles 3, and hence a uniform loading, by means of this flow of the length of material.

As the essential flow properties, in particular the flow volume, the flow speed and the spatial distribution of the flow into the slit nozzles 2 and the hole nozzles 3 depend on the structure of the rectangular sheet metal strip 6, the rectangular sheet metal strip 6 is mounted in detachable and hence exchangeable manner to the nozzle frame means 1. To that end, crossbars 8 (FIGS. 1 and 3) are provided at the upper end of the nozzle frame means 1 somewhat below the rectangular sheetmetal strip 6. The crossbars 8 extend perpendicularly to the longitudinal direction of the nozzle frame means, i.e., in the direction of the motion of the length of material. These crossbars 8 can be circular in cross-section, as indicated in FIG. 4*b*, or rectangular as in FIG. 1, and serve to stabilize the nozzle frame means. Moreover, the crossbars 8 are backed by brackets 7 mounted, for instance by welding, to the rectangular sheetmetal strip 6, which thereby hugs by its shape the crossbars 8 and can be removed from them. Further, block-shaped projections 9 (FIG. 3) are mounted on the crossbars 8 at a precisely defined spacing from each other and from the inside walls of the nozzle frame means 1. The width of the brackets 7 is somewhat less than the spacings between the projections 9, whereby the brackets 7 can be inserted between the projections 9 and hence the rectangular sheetmetal strip 6 can be centered between the inside walls of the nozzle frame means 1. In this manner and without any further adjustment, a precisely defined width of the slit nozzles 2 is achieved at the edges of the nozzle frame means 1 defining, in turn, the slit jets issuing from the slit nozzles 2.

Figure 4A:
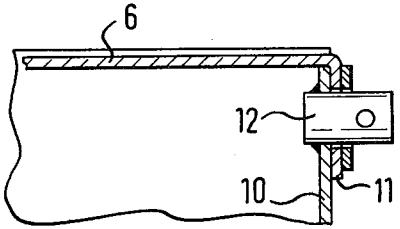
FIGS. 4*a* and 4*b* show the fastening of the rectangular sheet metal strip to the nozzle frame means.
Figure 4B:
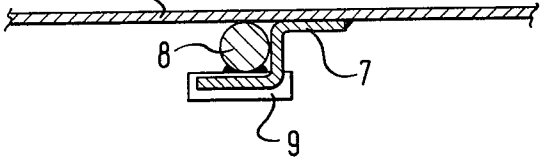

The rectangular sheetmetal strip 6 is bent by an angle of 90° at one end of the nozzle frame means 1, providing thereby a side portion or flap 11 as indicated in FIG. 4*a*. This side portion 11 is slipped on a bolt means 12 welded into the sealing metal 10 of the nozzle frame means 1.

Thus the rectangular sheetmetal strip 6 is aligned with respect to the nozzle frame means 1 during the assembly and kept in place in shape-locking manner, so that it can be exchanged without high expenditure of labor or time.

As shown by FIG. 3, the rectangular sheetmetal strip is located somewhat below the upper edges of the sidewalls of the nozzle frame means 1, thereby creating a trough between the upper ends of the sidewalls of the nozzle frame means 1 and the rectangular sheetmetal strip 6, improving the support force especially when the length of material is close-by.

When the nozzle frame means 1 is of constant width, the width of the slit nozzles 2 and hence of the slit jets depends only on the width of the rectangular sheetmetal strip 6. That is, changing the width of the rectangular sheetmetal strip 6 allows varying the width of the slit jets. If, for instance, the system of nozzles should have a high support surface and a moderate heat transfer from the blowing medium to the length of material to be guided, then broader slit jets and a lesser number of hole nozzles are required.

If high heat transfer is desired, the area of the hole nozzles 3 must be correspondingly increased and, moreover, the diameter of the hole nozzles 3 must be so selected that the length of the material to be treated will also be loaded by the core jet of the flow issuing from the hole nozzles 3.

The support force can be varied within wide limits as a function of the desired heat transfer and vice versa by using a rectangular sheetmetal strip 6 of corresponding width and a corresponding number and size of hole nozzles 3 in a system of nozzles such as described.

Figure 5:
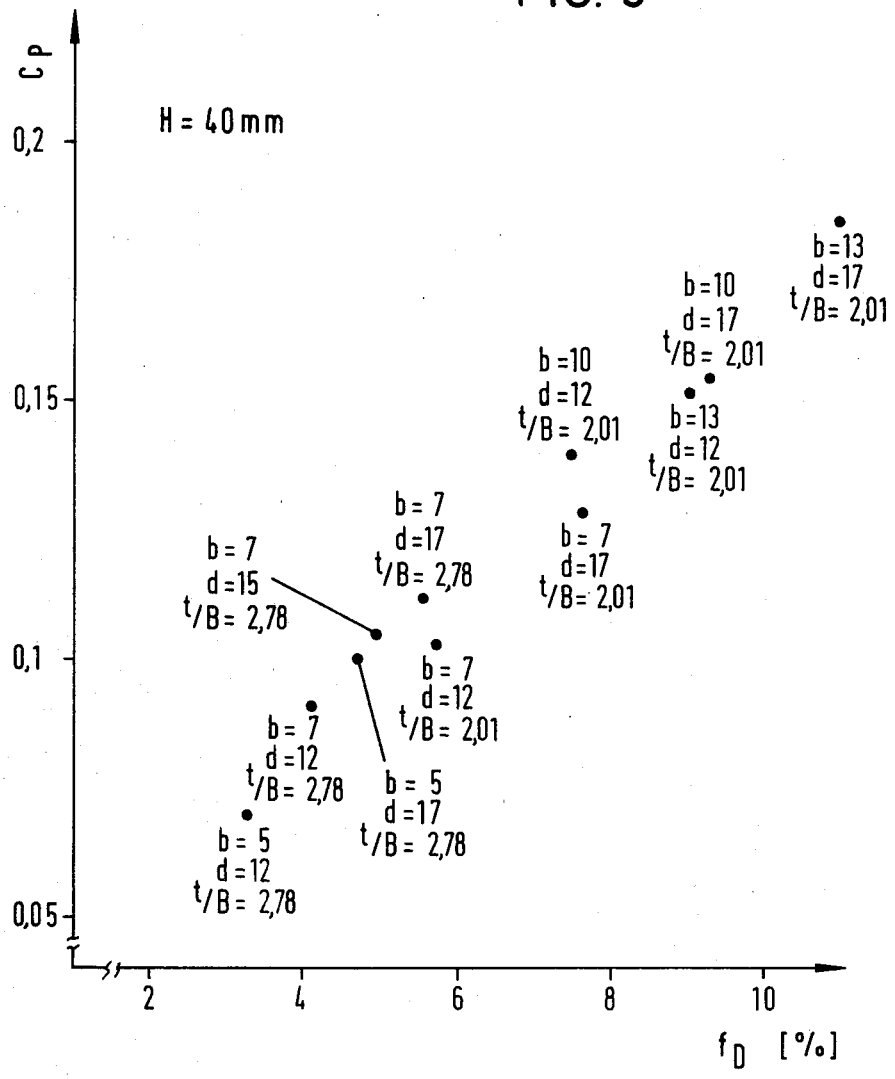
FIG. 5 is a curve of the relation between the support-force coefficient $c_p$ and the open nozzle surface $f_D$ for the various embodiments of the nozzle system.
Figure 6:
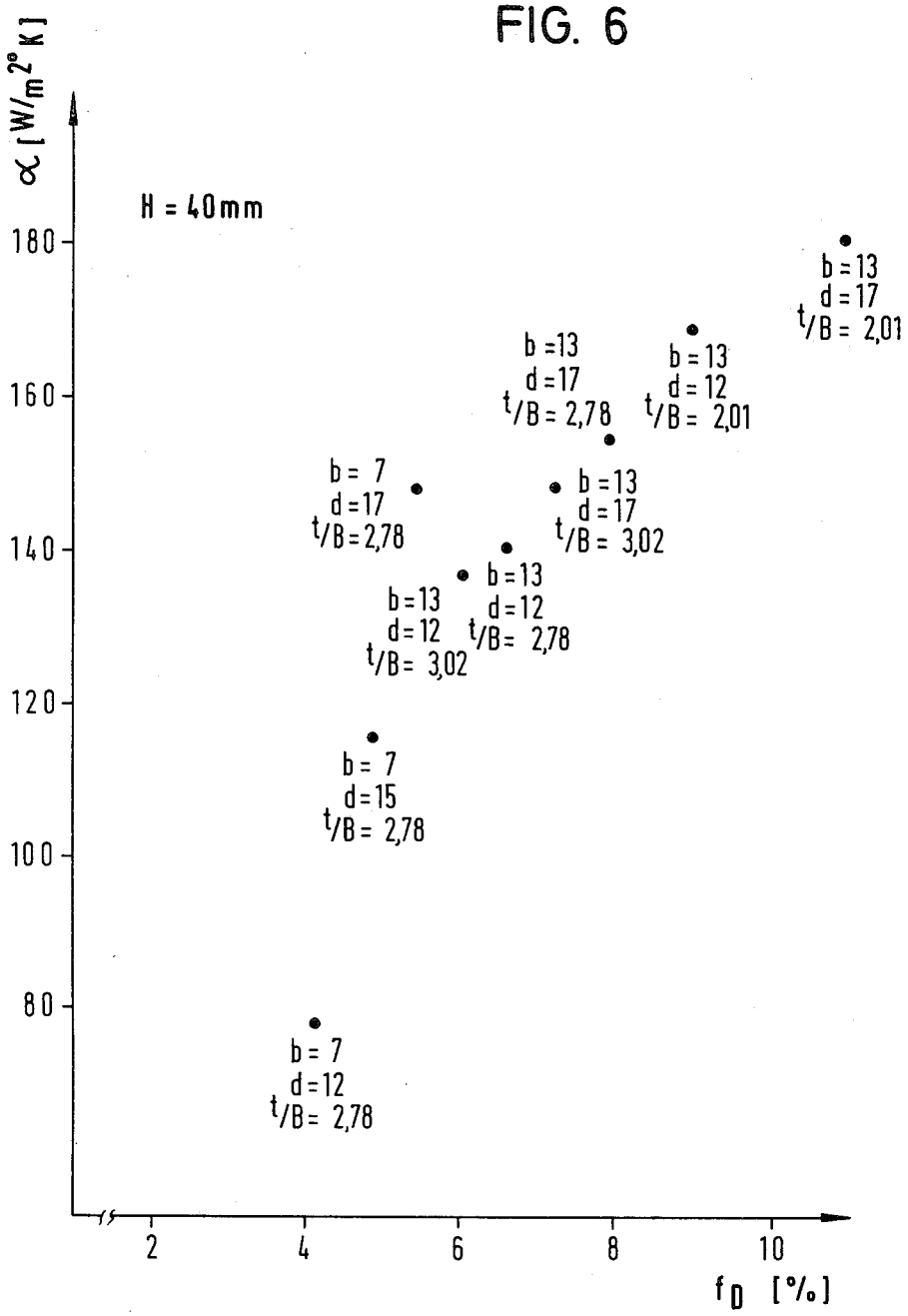
FIG. 6 is a curve of the relation between the heat-transfer coefficient of $\alpha$ and the open nozzle surface $f_D$ for various nozzle systems.

These relations are shown in the diagrams of FIGS. 5 and 6. The diagram 5 shows the relation between the support-force coefficient $c_p$ and the open nozzle area $f_D$ referred to the entire surface of the nozzle frame means for various designs of such a system of nozzles. The support-force coefficient $c_p$ is defined as the ratio of the support force per area for one-sided blowing to the nozzle pressure head. The width of the slit nozzles 2 is denoted by "b". The diameter of the hole nozzles 3 is denoted by "d" and "t" is the spacing of the nozzle arms or ribs, each one comprising a complete nozzle frame means with sheet metal strip. "B" is the width of each of the nozzle arms or ribs, and "H" is the spacing between the length of material and the nozzle frame means. The dimensions are in millimeters. FIG. 5 indicates that essentially the support-force coefficient $c_p$ increases with increasing transmission by the nozzle plate, i.e., of the rectangular sheetmetal strip 6, namely with increasing $f_D$.

Diagram 6 shows the heat transfer coefficient $\alpha$ measured for similar experimental procedures for the same various systems of nozzles as a function of the transmission of the nozzle frame means 1. FIG. 6 shows that, as a function of the proportion of hole jets from the hole nozzles 3 or of slit jets from the slit nozzles 2 in the nozzle frame means surface and at constant nozzle transmission, much differing heat transfer coefficients are obtained or vice versa: the same heat transfer coefficient is obtained for substantially different, relative nozzle surfaces. This diagram moreover shows that an increase in heat transfer is obtained, especially by increasing the proportion of the hole jets while increasing the proportion of the slit nozzles 2 and hence the slit jets, has less of an effect on the heat transfer coefficient.

Regarding an enamel drying facility wherein a length of material provided with a delicate coating is to be guided in a floating manner, a rectangular sheetmetal strip 6 should be used with relatively small hole nozzles 3 to prevent the delicate surface of the length of material from being loaded by core jets, whereby markings might result on the surface of the length of material.

What is claimed is:

1. A system of nozzles for guiding a length of material in a floating manner by a blowing medium, comprising nozzle frame means with slit nozzles extending laterally transversely to the direction of motion of the length of material having hole nozzles between the slit nozzles, characterized by a guide-vane grille arranged along the axis of the nozzle frame means for the supplied blowing medium and a diffuser joining the guide-vane grille with an exhaust impedance for delaying the blowing medium in separation-free manner.

2. A system of nozzles according to claim 1 characterized in that the diffuser is formed by surfaces joining the guide-vane grille and extending from upper edges of the guide-vane grille in the direction of flow as far as an inside wall of the nozzle frame means.

3. A system of nozzles according to claim 2 characterized in that the surfaces of the diffuser are formed of sheetmetal.

4. A system of nozzles according to any one of claims 1, 2 or 3 characterized in that the exhaust impedance of the diffuser is formed by a nozzle plate having perforations forming hole nozzles.

5. A system of nozzles according to claim 4 characterized in that the width of the nozzle plate is slightly less than that of the nozzle frame means.

6. A system of nozzles according to claim 5 characterized in that the nozzle plate consists of a perforated rectangular sheetmetal strip.

7. A system of nozzles according to claim 6 characterized in that the ratio of the width of the sheetmetal strip and hence of the width of the slit nozzles to the total area of the hole nozzles is variable.

8. A system of nozzles according to claim 6 characterized in that the center points of the hole nozzles of the rectangular sheetmetal strip are located at the tips of equilateral triangles.

9. A system of nozzles according to claim 6 characterized in that the rectangular sheetmetal strip is exchangeably mounted to the nozzle frame means.

10. A system of nozzles according to claim 9 characterized in that said nozzle frame means includes sidewalls and crossbars mounted transverse to said axis between said sidewalls, and the rectangular sheetmetal strip comprises brackets facing the diffuser and held in position in shapelocking manner on the crossbars of the nozzle frame means.

11. A system of nozzles according to claim 10 characterized in that the crossbars comprise lateral stop means for centering the brackets and hence the rectangular sheetmetal strip between the sidewalls of the nozzle frame means.

12. A system of nozzles according to claim 11 characterized in that said nozzle frame means further includes bolt means fastened to said sidewalls, and the exchangeable rectangular sheetmetal strip comprises a flap bent around at one end of the nozzle frame means and slipped on the bolt means fastened to the nozzle frame means.

* * * * *